US005154289A

United States Patent [19]

Van Erden

[11] Patent Number: 5,154,289

[45] Date of Patent: Oct. 13, 1992

[54] CONTAINER PACKAGE

[75] Inventor: Donald L. Van Erden, Wildwood, Ill.

[73] Assignee: Illinois Tool Works, Inc., Glenview, Ill.

[21] Appl. No.: 776,639

[22] Filed: Oct. 15, 1991

[51] Int. Cl.[5] ..... B65D 65/02

[52] U.S. Cl. ..... 206/432; 206/150; 206/427

[58] Field of Search ..... 206/432, 427, 150

[56] References Cited

U.S. PATENT DOCUMENTS

| | | | |
|---|---|---|---|
| 3,874,502 | 4/1975 | Weaver | 206/150 |
| 4,018,331 | 4/1977 | Klygis | 206/199 |
| 4,219,117 | 8/1980 | Weaver et al. | 206/150 |
| 4,815,589 | 3/1989 | Allen et al. | 206/432 |
| 4,828,110 | 5/1989 | Lems | 206/427 |
| 5,018,620 | 5/1991 | Marco et al. | 206/150 |

*Primary Examiner*—William I. Price

*Attorney, Agent, or Firm*—Trexler, Bushnell, Giangiorgi & Blackstone, Ltd.

[57] ABSTRACT

A package for releasably holding a plurality of containers comprises an arraying device, a plurality of containers, and encompassing means. The arraying device releasably holds the containers together to form a predetermined array. The containers have a bottom, and are insertable into the arraying device so that the arraying device is located proximate to the bottoms. The arraying device loosely retains the containers therewithin. The encompassing means surrounds the containers and the arraying device for retaining the containers.

16 Claims, 1 Drawing Sheet

CONTAINER PACKAGE

BACKGROUND AND SUMMARY OF THE INVENTION

The present invention relates generally to a unique construction for a container package for holding a plurality of containers or the like together as a single unit.

Packaging a plurality of containers together as a single unit can be achieved in a wide variety of ways and methods commonly known to those individuals having ordinary skill in the relevant art. Such ways and methods include, for example, encompassing containers in cardboard boxes and trays to form a "case" or a "twelve pack," encircling the outer band margins of the containers with a flexible, resilient material to form a web-like container carrier, and further surrounding the containers with a flexible, resilient material that shrinks or stretches upon the application of heat or an appropriately directed force, respectively. U.S. Pat. Nos. 3,874,502, 4,018,331, and 4,219,117, disclose the structure and functionality of the container carrier. These patents are assigned to the assignee of the present invention, and the disclosures thereof are incorporated herein by reference.

One of the more popular methods of packaging a plurality of containers is to surround the containers with a sheet of heat shrinkable polymetric film material which shrinks upon application of heat to conform to the exterior configuration defined by the plurality of containers, thereby captivating the same. A pattern of slits or perforations can be supplied to the sheet of polymetric film material either before or after the heat shrinking process so that sheet may be ruptured to release the containers. Similarly, stretch wrap film material may also be used in place of the heat shrink wrap.

Use of each of these various methods results in a differently formed, yet similarly functioning package. However, some of those packages are incapable of positively retaining the plurality of containers in a certain, pre-determined configuration or array. This can cause problems, especially in a warehouse or a store, for example, wherein packages must be stacked in order to maximize use of limited space. If the packages allow the containers therein to move about, thereby disrupting the pre-determined array, a workman may encounter great difficulty in properly storing the package, while still maximizing use of the limited space.

A package, constructed according to the teachings of the present invention, is intended to assist in solving those problems, among others, resulting in greater convenience to the user. The package of the invention is functionally distinct from the container carriers disclosed in the above-referenced patents. While the container carriers are intended to releasably hold a plurality of containers together for transport, the package of the invention has an array which maintains the containers in a predetermined configuration within the package.

OBJECTS AND SUMMARY OF THE INVENTION

A general object of the present invention is to provide a new and useful package for containers and the like.

A more specific object of the invention is to provide a container package having container arraying means for arraying a plurality of containers, and for maintaining that array.

Another object of the present invention is to provide a container package which can maintain containers arrayed in ranks and rows.

An additional object of the invention is to provide a container package which can be used as a distributor package.

A further object of the present invention is to provide a container package which permits removal of one container while maintaining pre-determined arrangement of other containers retained by the device.

Yet another object of the invention is to provide a container package having arraying means reactive to bending forces applied to the device for maintaining the containers in substantially the same plane during handling.

An additional object of the present invention is to provide a container package having arraying means which relatively loosely retains containers therein, thereby facilitating their removal therefrom.

A further object of the invention is to provide a container package having arraying means for positively defining an array to be formed by a plurality of containers.

Another object of the present invention is to provide a container package having arraying means comprised of a material having a relatively low resiliency.

A container package, constructed according to the teachings of the present invention, for releasably holding a plurality of containers together to form an array comprises an arraying device, a plurality of containers, and encompassing means. The arraying device releasably holds the containers together to form a predetermined array. The containers have a bottom, and are inserted into the arraying device so that the arraying device is located proximate to the bottoms. The arraying device loosely retains the containers therewithin. The encompassing means surrounds the containers and the arraying device for retaining the containers.

BRIEF DESCRIPTION OF THE DRAWINGS

The organization and manner of the structure and operation of the invention, together with further objects and advantages thereof, may best be understood by reference to the following description taken in connection with the accompanying drawings, wherein like reference numerals identify like elements in which.

DETAILED DESCRIPTION OF THE PREFERRED EMBODIMENT

Figure 1:
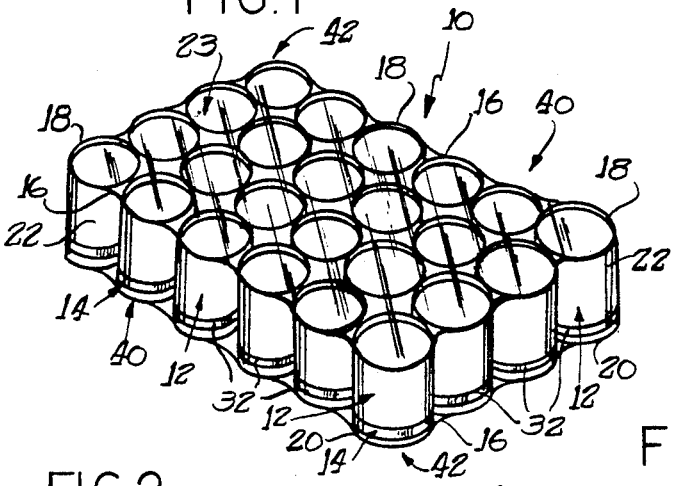
FIG. 1 is a perspective view of the container package, constructed according to the teachings of the present invention, for releasably holding a plurality of containers.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Referring initially to FIG. 1, a container package 10, constructed according to the teachings of the present invention, for releasably retaining a plurality of containers 12 is perspectively illustrated.

While the container package 10 is shown in the Figures, and will be described in detail with respect to releasably retaining twenty four containers 12 in the form of substantially cylindrical cans, it is to be fully understood that the scope of the present invention is not to be limited to employment with any specific number of any type of containers or other articles. The teachings of the invention can be utilized equally well with any number of variously constructed containers 12 or other articles. Moreover, although the container package 10 is shown and will be described with relation to a substantially rectangular array, it is to be understood that otherly configured arrays may also be accomplished by use of the invention.

The container package 10 generally comprises a plurality of containers 12, two arraying devices 14, and encompassing means 16. The container 12 may be substantially cylindrical in shape, having a top 18 and a bottom 20. The top 18 is joined to the bottom 20 by a substantially cylindrical body 22. The body 22 is hollow, thereby allowing the container 12 to hold material inside. Other container constructions can also be utilized, as indicated above.

Figure 4:
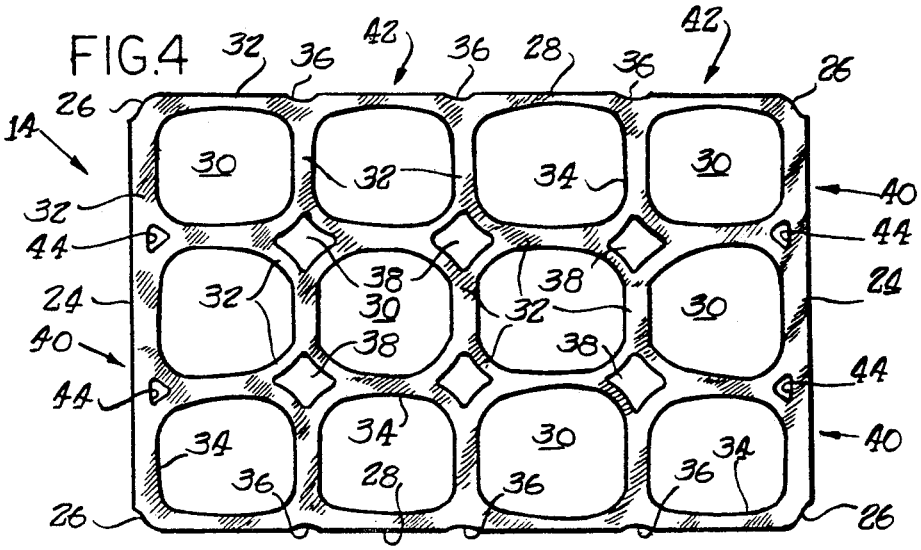
FIG. 4 is a top plan view of unique arraying means for use with the package of FIG. 1.

Referring to FIG. 4, the arraying means or device 14 is illustrated. The device 14 may be composed of a suitable material, such as a plastic like polyethylene, having a certain degree of elasticity and resiliency, as will be discussed herein. Preferably, the array 14 is composed of a polyethylene material substantially similar to that disclosed in the above-referenced '502 patent. The particular arraying device 14 of FIG. 4 is constructed to form a rectangular array 23 of containers 12, however, as stated above, the arraying device 14 can be constructed to form arrays 23 having different shapes and sizes.

The arraying means or device 14 can be formed from a substantially flat, sheet-like blank, not shown, of suitable flexible plastics material. Accordingly, a plurality of arraying device 14 can be formed continuously along a continuous web-type operation. Adjacent arraying device 14 are joined along substantially linear, common latitudinal edges 24 along opposite sides thereof, which can be ruptured to free one arraying device 14 from the continuous web. Thus, there are at least two latitudinal edges 24 on opposite sides of each arraying device 14.

Once ruptured, the latitudinal edges 24 terminate at rounded corners 26 on opposite ends thereof. These rounded corners 26 facilitate flexing of the arraying device 14, as will be discussed more fully herein. Longitudinal edges 28 join the latitudinal edges 24 at the rounded corners 26. The arraying device 14 is thusly substantially rectangular in external shape.

A plurality of container accepting holes 30 are disposed in the arraying device 14 between the boundaries defined by the latitudinal and longitudinal edges 24 and 28. The holes 30 are of dimensions sufficient to accept the body 22 of the container 12. The holes 30 are defined by a plurality of container encircling bands 32 which define the demarcation between adjacent holes 30 and which confront and engage the body 22 of the container 12.

The holes 30 are arranged in the arraying device 14 to form a certain, predetermined array 23 of containers 12 when the same have been inserted therein. The containers 12 are thereby arranged in ranks 40 and rows 42 to form the array 23. The particular rectangular array 23 illustrated in the Figures is only one of many arrays 23 which can be formed by appropriately constructed arraying device 14.

Each of the container encircling bands 32 has a container engaging band margin 34 which actually confronts and engages the body 22 of the container 12. The band margin 34 is of a dimension slightly smaller than a corresponding dimension on the body 22 of the container 12. In this way, the elasticity of the material comprising the arraying device 14 allows the band margin 34 to expand in order to accept the body 22 of the container 12. However, due to the resiliency inherent in that material, the band margin 34 can constrict around the body 22 of the container 12 for releasably holding and retaining the container 12 within the hole 30.

It is to be noted that the thickness of the material comprising the arraying device 14 is somewhat less than that commonly found in the material comprising container carriers, such as those disclosed in the above-referenced patents. For example, the thickness of the arraying device 14 may be about 0.008 inches, while the thickness of a container carrier is typically about 0.016 inches. Because those container carriers are provided for sustaining the weight of the containers, the carrier material must have a relatively high strength in order to effectively retain the containers. On the other hand, the arraying device 14 primarily holds the containers 12 against relatively shifting within the predetermined array 23 while the weight is primarily supported by the encompassing means 16 described below.

Additionally, because of the functional differences between the container carriers and the array 14, the array 14 is applied to the containers 12 in a slightly different fashion. Specifically, whereas the container carriers are applied to the containers by stretching the carriers approximately within the range of twenty five to thirty percent, the array 14 is only stretched approximately within the range of five to ten percent upon application to the containers 12. Because the array 14 is stretched to a lesser degree when applied to the containers 12, the array 14 holds the containers 12 to a proportionally lesser degree as compared to the container carriers.

The arraying device 14, as will be discussed herein, is located proximate to the bottoms 20 of the containers 12. The material of the arraying device 14 has a resiliency sufficient to retain the containers 12 within the holes 30 and to maintain the desired, pre-determined array 23. The resiliency is also sufficient to react to bending forces applied to the container package 10 during handling for keeping the containers 12 all in substantially the same plane defined thereby.

The resiliency of the material is sufficiently weak, and/or the degree of interference between the containers 12 and the band margins 34 is sufficiently small to permit easy individual removal of a container 12 without disrupting the array 23 of remaining containers 12 formed by the arraying device 14. These properties of the container package 10 allow it to function effectively as a distributor package for a plurality of containers 12, which is usually opened, such as in a store, to allow selective removal of a subset of the plurality for purchase.

Once the body 22 of the container 12 is inserted into the hole 30, the band margin 34 constricts somewhat therearound, causing the container encircling bands 32 to flex and to conform to the external configuration of the body 22. The container 12 is inserted into the hole 30 so that the container encircling bands 32 will be located on the body 22 proximate to the bottom 20 once they have flexed properly.

Means to facilitate this flexing and conforming in the form of external scallops 36 and internal scallops 38 are disposed on the arraying device 14 in association with the holes 30. The scallops 36 and 38 represent portions removed from the container encircling bands 32 to encourage their flexing around the body 22 of the container 12.

The external scallops 36 are disposed along the longitudinal edges 28 of the arraying device 14. The external scallops 36 are substantially arcuate in shape, defining an arc which extends concavely from the longitudinal edges 28 towards the interior of the arraying device 14. The external scallops 36 are preferably located along the longitudinal edges 28 between adjacent rows 42 of holes 30 to facilitate flexing of the associated container encircling bands 32.

Additional flexibility is provided by notches 44 disposed on the arraying device 14. The notches 44 also represent portions removed from the arraying device 14, and are substantially triangular in shape. The notches 44 are located adjacent the latitudinal edges 24 of the arraying device 14 between adjacent ranks 40 of the holes 30. The notches 44 cooperate with the rounded corners 26 and the external scallops 36 to facilitate flexing of the container encircling bands 32, especially those associated with the holes 30 disposed at the corners of the arraying device 14.

The internal scallops 38 are disposed on the arraying device 14 between the boundaries defined by the latitudinal edges 24 and the longitudinal edges 28. The internal scallops 38 are located on the container encircling bands 32 between holes 30 in adjacent ranks 40 and rows 42. Specifically, the internal scallops 38 are located at the junctures between the container encircling bands 32 parallel to the latitudinal edges 24 and the container encircling bands 32 parallel to the longitudinal edges 28. The internal scallops 38 are preferably substantially cruciform in shape, and function substantially similarly to the rounded corners 26, the external scallops 36, and the notches 44 to facilitate flexing and conforming of the container encircling bands 32.

The encompassing means 16 can take on a plurality of forms well known in the art. Preferably, the encompassing means 16 comprises a thin sheet or film of low density linear polyethylene, a shrinkable wrapping material which is shrinkable upon application of heat (i.e. heat shrink wrap), or, alternatively, a stretchable wrapping material which is shrinkable upon application of an appropriately directed force (i.e. stretch wrap). The encompassing means 16 is applied to the entirety of the exterior of the containers 12 and the arraying device 14 in order to positively retain the containers 12 together in the arraying device 14.

Figure 2:
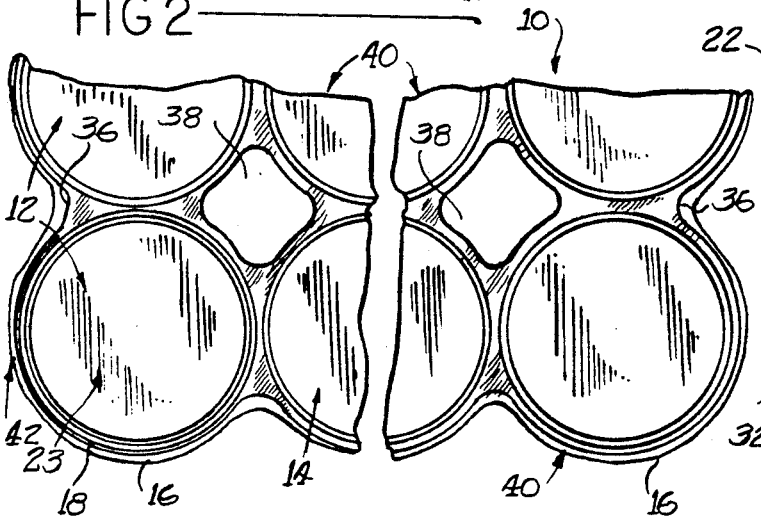
FIG. 2 is a partial top plan view of the package illustrated in FIG. 1.

The encompassing means 16 is appropriately shrunk or stretched so as to conform closely to the external configuration formed by the containers 12 and the arraying device 14, as illustrated in FIG. 2. To facilitate use of the container package 10 as a carrier, the encompassing means 16 may be provided with handle means, such as in the form of a bullseye, and/or opening means, such as in the form of slits or perforations disposed thereon. The encompassing means 16 can be opened in a plurality of ways, including by the application of an appropriate tool, such as a knife.

With the structure of the container package 10 thusly disclosed, the construction and operation of the same will now be discussed. A particularly desired shape of an array 23 is chosen, and a correspondingly constructed arraying device 14 is selected. The arraying device 14 is applied to the cylindrical bodies 22 of the containers 12 by means well known in the relevant art. The holes 30 accept the containers 12.

The arraying device 14 is positioned on the cylindrical bodies 22 proximate to the bottoms 20 thereof. The rounded corners 26, the external and internal scallops 36 and 38, respectively, and the notches 44 facilitate the band margins 34 of the container encircling bands 32 in flexing to confront and engage the cylindrical bodies 22 of the containers 12. Because the material comprising the arraying device 14 has a proper degree of resiliency, and because of the minimal interference between the device 14 and the containers 12, the arraying device 14 holds the containers 12 therein relatively loosely. The arraying device 14 has now formed the desired array 23 of the containers 12.

Figure 3:
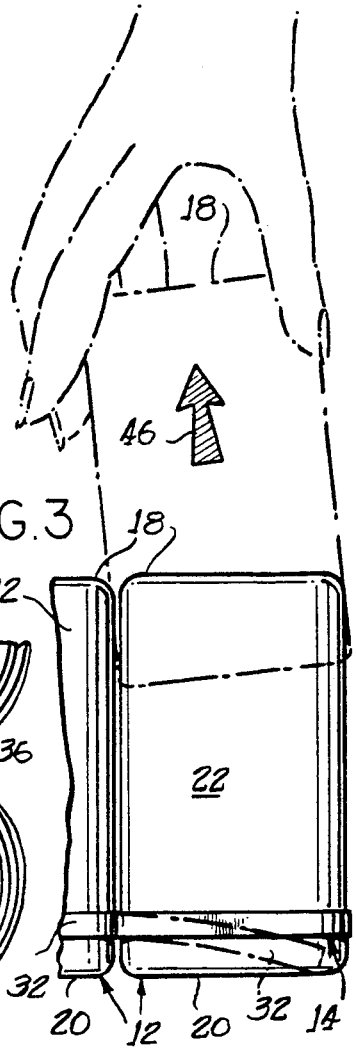
FIG. 3 is a side elevational view of the package of FIG. 1 with encompassing means removed from the external configuration thereof, illustrating in phantom removal of one of the containers.

The encompassing means 16 is applied to the external configuration defined by the containers 12 and the arraying device 14. The encompassing means 16 is wrapped around the external configuration to cover substantially the entirety of the surface area of the external configuration. The encompassing means 16 is then shrunk or stretched by appropriate means to conform strictly to the external configuration, and to firmly hold the containers 12 together within the arraying device 14. The container package 10 is now completed. It is to be noted that a plurality of arraying devices 14 releasably holding containers 12 can be arranged side-by-side, as shown in FIG. 1, with the encompassing means 16 being wrapped around the external configuration formed by the containers 12 and the plurality of arraying means 14 to construct composite arrays 23. Alternatively, the package 10 could comprise a single arraying device 14 and twelve cans. To remove an individual container 12 from the container package 10, the encompassing means 16, or at least a portion thereof, must be removed, as shown in FIG. 3. A suitable tool may be used to do this, however, slits or perforations may be provided on the encompassing means 16 to facilitate opening and removal thereof.

Once the encompassing means 16 has been removed sufficiently, an upwardly directed force 46, indicated by the substantially vertical arrow in FIG. 3, is applied to the container 12 to free it from the hole 30 defined by the container encircling bands 32. This process is represented in phantom lines in FIG. 3.

Because the arraying device 14 holds the containers 12 therein relatively loosely, the magnitude of the force 46 required to free the container 12 from the arraying device 14 is substantially less than a force required to free a container from the container carriers discussed above. Because the force 46 is of such a relatively low magnitude, the container 12 can be removed from the arraying device 14 without upsetting the array 23. This is particularly desirable in distributor packages.

While a preferred embodiment of the present invention is shown and described, it is envisioned that those skilled in the art may devise various modifications of the present invention without departing from the spirit and scope of the appended claims. The invention is not intended to be limited by the foregoing disclosure, but only by the following appended claims.

The invention claimed is:

1. A package comprising: a plurality of containers having bottom ends disposed in a predetermined array; a flexible sheet material arraying device having a plurality of holes respectively receiving and relatively loosely releasably retaining the containers, as compared to a conventional container carrier which holds said container with a tight friction fit; the arraying device being located proximate to the bottom ends of the containers; and encompassing means surrounding the containers and the arraying device for retaining the containers.

2. A package as defined in claim 1 wherein the arraying device includes bands defining the holes and further comprising external scallops on the arraying device located between adjacent holes for facilitating flexing of the bands so that the holes can accept the containers and the bands can engage the containers.

3. A package as defined in claim 2 wherein the external scallops are substantially arcuate in shape.

4. A package as defined in claim 2 further comprising internal scallops located on the arraying device for facilitating flexing of the device so that the holes can accept the containers.

5. A package as defined in claim 4 wherein the internal scallops are substantially cruciform in shape.

6. A package as defined in claim 4 wherein the arraying device has a longitudinal edge and a latitudinal edge; and the internal scallops being located at a juncture between container encircling bands parallel to the longitudinal edge and container encircling bands parallel to the latitudinal edge.

7. A package as defined in claim 4 wherein the arraying device releasably holds the containers in ranks and rows; and the internal scallops being located on the arraying device between adjacent ranks.

8. A package as defined in claim 2 wherein the arraying device releasably holds the containers in ranks and rows; and the external scallops being located on the arraying means between adjacent rows.

9. A package as defined in claim 1 further comprising rounded corners on the arraying device for facilitating flexing of the device so that the holes can accept the containers.

10. A package as defined in claim 1 wherein the encompassing means comprises a sheet of material comprising one of the group consisting of heat shrinkable wrap material and stretch wrap material.

11. A package as defined in claim 1 wherein the arraying device can hold twelve containers.

12. A package as defined in claim 1 comprising twenty four containers.

13. A package as defined in claim 12 comprising two adjacent arraying devices with each arraying device retaining twelve containers.

14. A package comprising: a plurality of containers; a flexible resilient plastic sheet arraying device relatively loosely releasably receiving said containers, as compared to a conventional container carrier which holds said container with a tight friction fit, in a predetermined array; the containers having bottoms; holes disposed through the arraying device for relatively loosely locating said containers therein; the arraying device being located approximate to the bottoms; said holes having marginal edges of a circumference similar to but sufficiently less than a corresponding circumference of the containers for relatively loosely locating the containers therewithin for permitting individual removal of one container' without disrupting the predetermined array; and encompassing means surroundings the container sand the arraying device for retaining the containers and for preventing removal of said containers from said arraying device until the encompassing means has been removed.

15. A package as defined in claim 14 wherein the arraying device comprises a sheet of flexible material having a thickness on the order of 0.008 inches.

16. A package as defined in claim 14 wherein the arraying device is stretched approximately within the range of five to ten percent to accept the containers.

* * * * *